US012392357B2

(12) United States Patent
Kitagawa et al.

(10) Patent No.: US 12,392,357 B2
(45) Date of Patent: Aug. 19, 2025

(54) ROTATING DEVICE

(71) Applicant: MINEBEA MITSUMI Inc., Nagano (JP)

(72) Inventors: Masahiro Kitagawa, Kitasaku-gun (JP); Yukihiro Higuchi, Kitasaku-gun (JP)

(73) Assignee: MINEBEA MITSUMI Inc., Nagano (JP)

( * ) Notice: Subject to any disclaimer, the term of this patent is extended or adjusted under 35 U.S.C. 154(b) by 0 days.

(21) Appl. No.: 18/774,006

(22) Filed: Jul. 16, 2024

(65) Prior Publication Data

US 2025/0027513 A1 Jan. 23, 2025

(30) Foreign Application Priority Data

Jul. 20, 2023 (JP) ..... 2023-118364

(51) Int. Cl.

| | |
|---|---|
| ***F04D 29/58*** | (2006.01) |
| ***F04D 17/16*** | (2006.01) |
| ***F04D 29/28*** | (2006.01) |
| ***F04D 29/42*** | (2006.01) |

(52) U.S. Cl.

CPC ..... *F04D 29/5853* (2013.01); *F04D 17/16* (2013.01); *F04D 29/281* (2013.01); *F04D 29/4226* (2013.01)

(58) Field of Classification Search

CPC ..... F04D 17/16; F04D 25/06; F04D 29/281; F04D 29/4226; F04D 29/5806; F04D 29/5826; F04D 29/5833; F04D 29/5853

See application file for complete search history.

(56) References Cited

U.S. PATENT DOCUMENTS

| | | | | |
|---|---|---|---|---|
| 7,212,404 | B2 * | 5/2007 | Wang | H01L 23/427 257/E23.099 |
| 7,679,907 | B2 * | 3/2010 | Kaneko | G06F 1/203 174/15.1 |
| D694,199 | S * | 11/2013 | Lin | D13/179 |
| 9,025,328 | B2 * | 5/2015 | Chiang | H05K 7/20154 361/679.48 |
| 9,059,146 | B2 * | 6/2015 | Inoue | G06F 1/20 |
| 9,756,761 | B2 * | 9/2017 | Inoue | H05K 7/20154 |
| 11,512,711 | B2 * | 11/2022 | Sun | F04D 17/16 |
| 2008/0105410 | A1 * | 5/2008 | Hwang | G06F 1/20 165/122 |
| 2008/0180913 | A1 | 7/2008 | Kaneko | |
| 2011/0005728 | A1 * | 1/2011 | Hong | G06F 1/20 165/122 |

(Continued)

FOREIGN PATENT DOCUMENTS

JP 2008-187120 A 8/2008

*Primary Examiner* — Brian P Wolcott

(74) *Attorney, Agent, or Firm* — Chrisman Gallo Tochtrop LLC

(57) ABSTRACT

A rotating device includes a shaft, an impeller fixed to the shaft, a motor causing the impeller to rotate, and a casing accommodating the impeller and the motor. The casing includes a suction port and a discharge port for a fluid. The casing and a heat sink are adjacent in a radial direction of the impeller. The heat sink includes a first part adjacent to the discharge port and a second part disposed inside the discharge port. The first part is in contact with a heat pipe. The second part is in contact with the casing in an axial direction of the impeller.

5 Claims, 6 Drawing Sheets

(56) References Cited

U.S. PATENT DOCUMENTS

| | | | | |
|---|---|---|---|---|
| 2012/0018132 | A1* | 1/2012 | Chen | F28D 15/0233 165/104.34 |
| 2012/0293958 | A1* | 11/2012 | Lee | H05K 7/20336 165/104.26 |
| 2014/0102670 | A1* | 4/2014 | Tu | H01L 23/427 165/104.26 |
| 2014/0182818 | A1* | 7/2014 | Wang | G06F 1/20 165/104.21 |

* cited by examiner

ROTATING DEVICE

CROSS-REFERENCE TO RELATED APPLICATIONS

This application claims the benefit of priority to Japanese Patent Application Number 2023-118364 filed on Jul. 20, 2023. The entire contents of the above-identified application are hereby incorporated by reference.

TECHNICAL FIELD

The disclosure relates to a rotating device.

BACKGROUND

Computers sometimes include a housing, a heat generating element mounted in the housing, a cooling fan arranged in the housing, a heat radiating fin disposed in the housing opposed to the cooling fan, and a heat transfer member thermally connecting the heat spreader fin to the heat generating element (e.g., see JP 2008-187120 A).

SUMMARY

However, the technology described in JP 2008-187120 A has room for improvement in facilitating the manufacturing of the fan (rotating device).

The disclosure has been made in view of the above, and one object of the disclosure is to provide a rotating device easy to manufacture while improving cooling performance.

To solve the above problem and achieve the object, a rotating device according to the disclosure includes a shaft, an impeller fixed to the shaft, a motor causing the impeller to rotate, and a casing accommodating the impeller and the motor. The casing includes a suction port and a discharge port for a fluid. The casing and a heat sink are adjacent in a radial direction of the impeller. The heat sink includes a first part adjacent to the discharge port and a second part disposed inside the discharge port. The first part is in contact with a heat pipe. The second part is in contact with the casing in an axial direction of the impeller.

One aspect of the rotating device according to the disclosure facilitates the manufacturing of the rotating device while improving the cooling performance.

DESCRIPTION OF EMBODIMENTS

Figure 1:
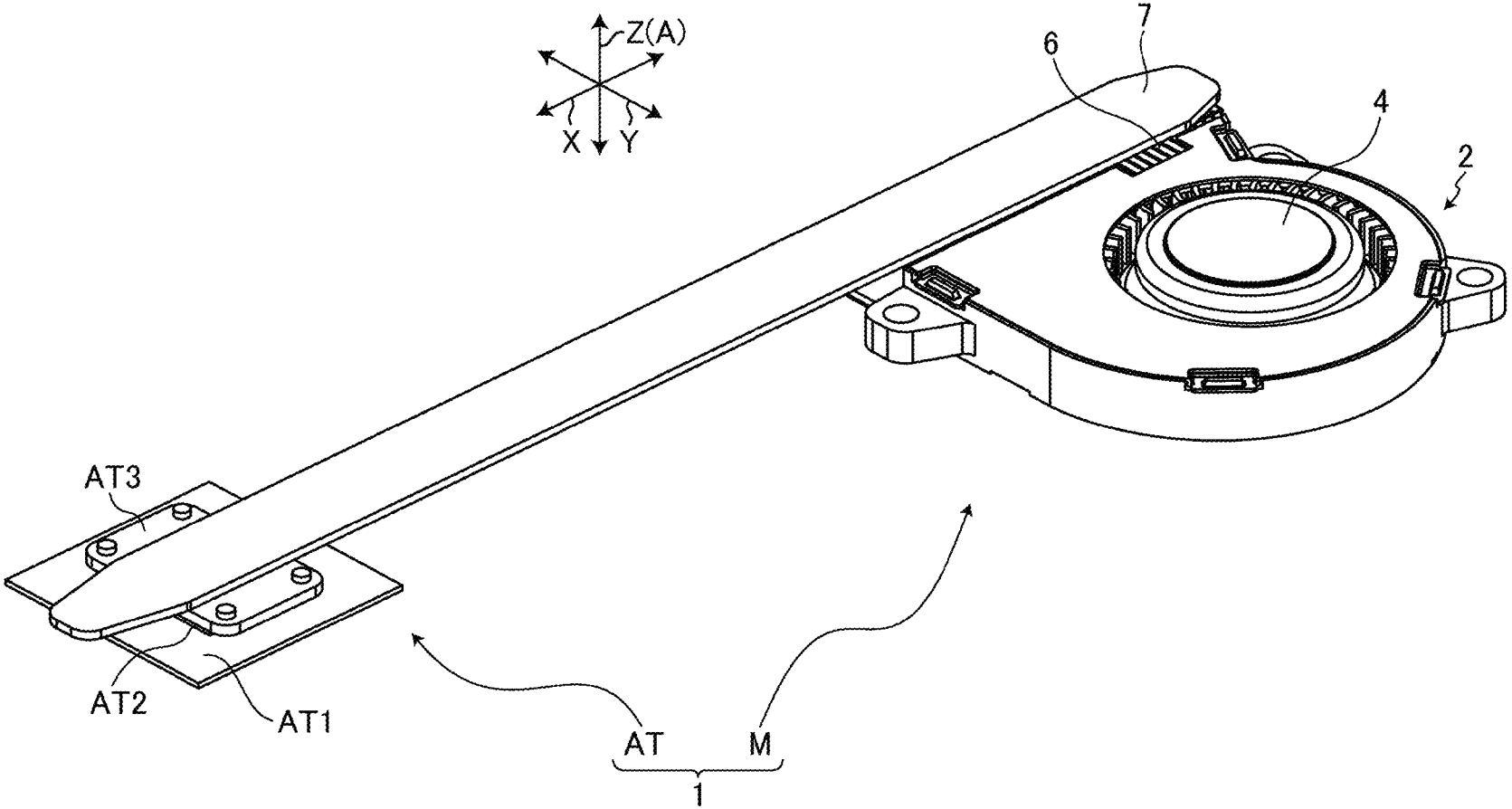
FIG. 1 is a perspective view illustrating a rotating device according to an embodiment.

Embodiments of a fan 1 as a rotating device will be described in detail below based on the drawings. It should be noted that the dimensional relationship of each element and the ratio of each element in the drawings may differ from reality. In some cases, the dimensional relationship and the ratios in the drawings may differ from each other.

Embodiments

Figure 2:
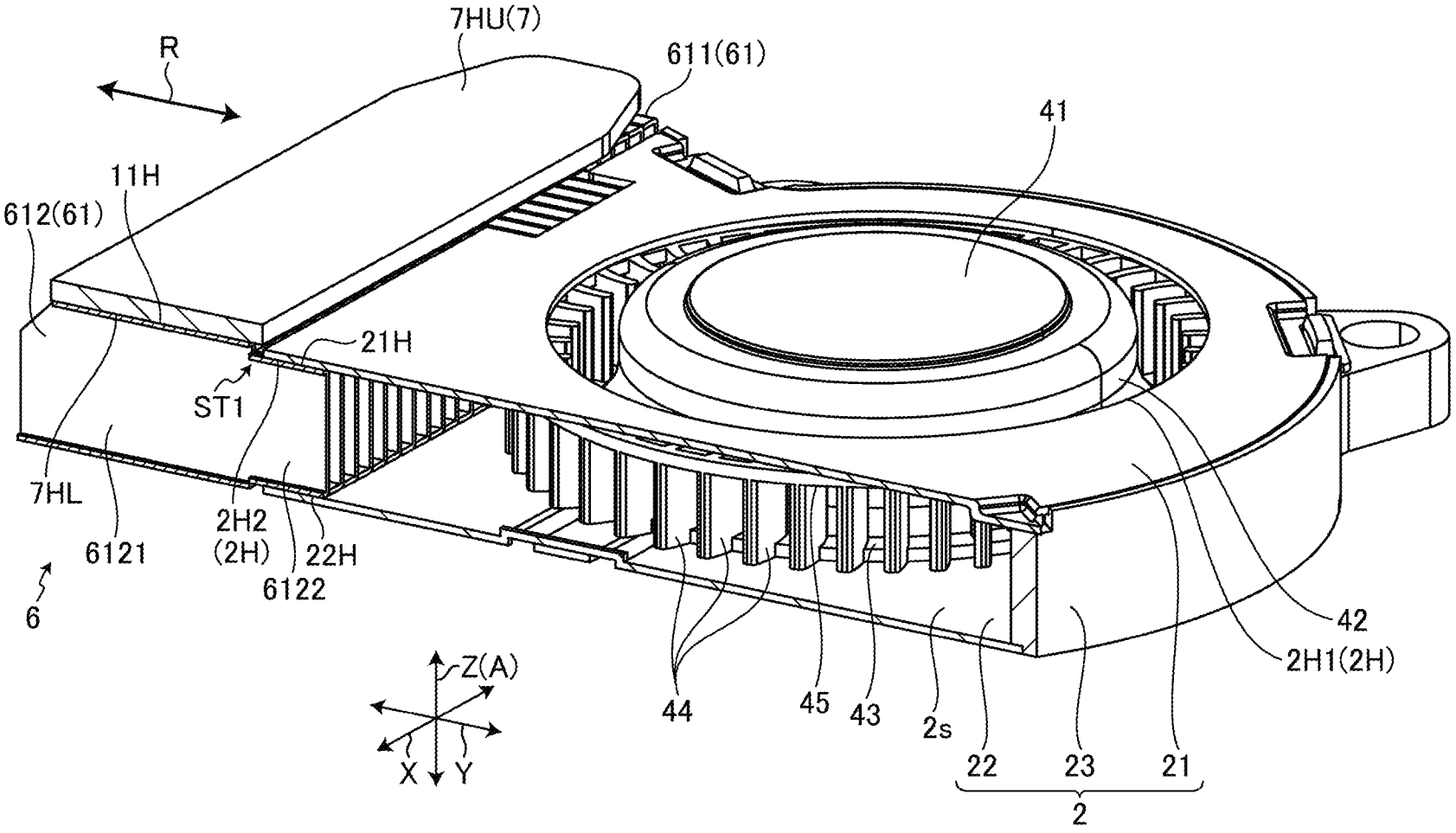
FIG. 2 is a cross-sectional view of a part of a main body of the rotating device illustrated in FIG. 1.
Figure 3:
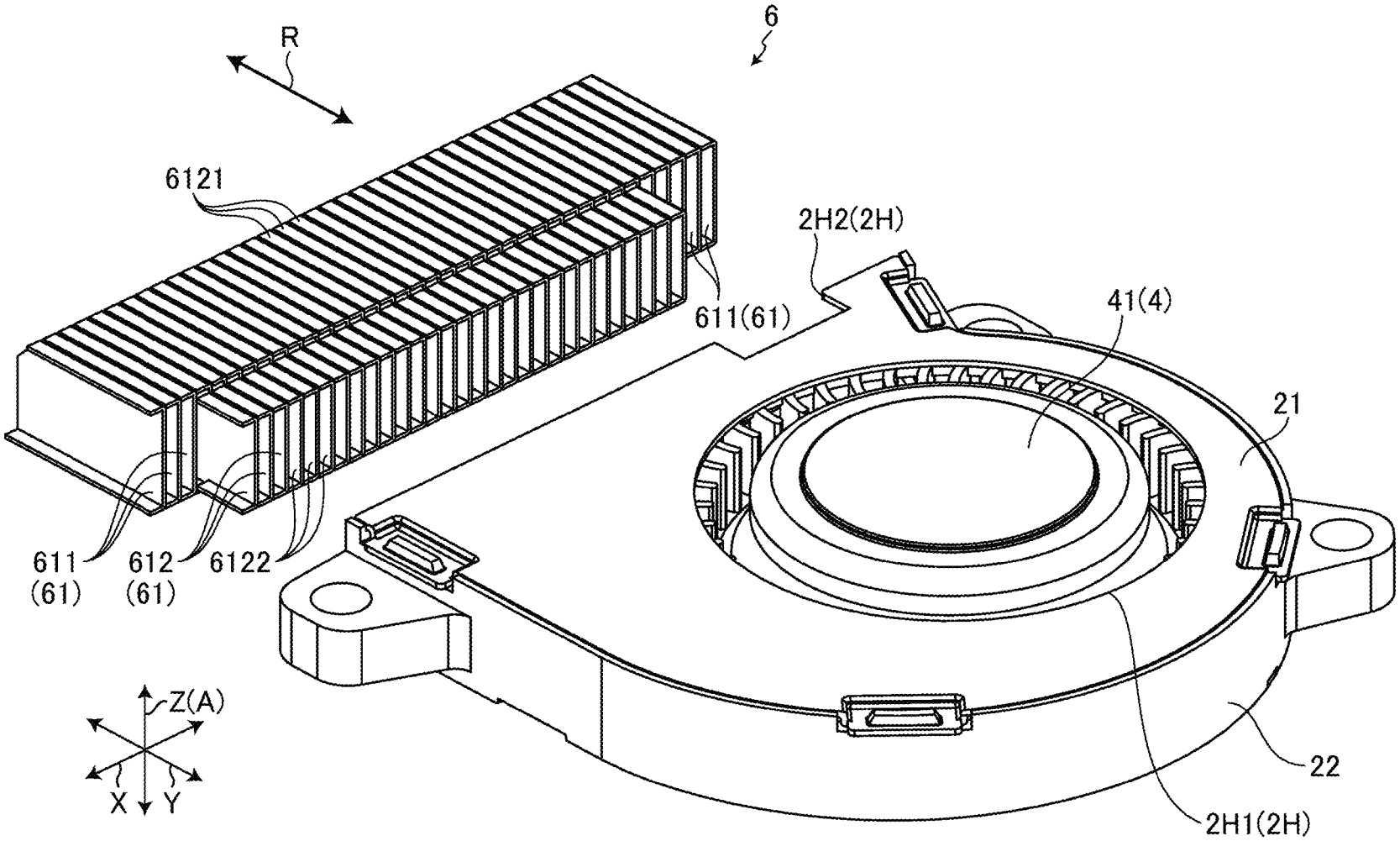
FIG. 3 is an exploded perspective view of the main body illustrated in FIG. 2.
Figure 4:
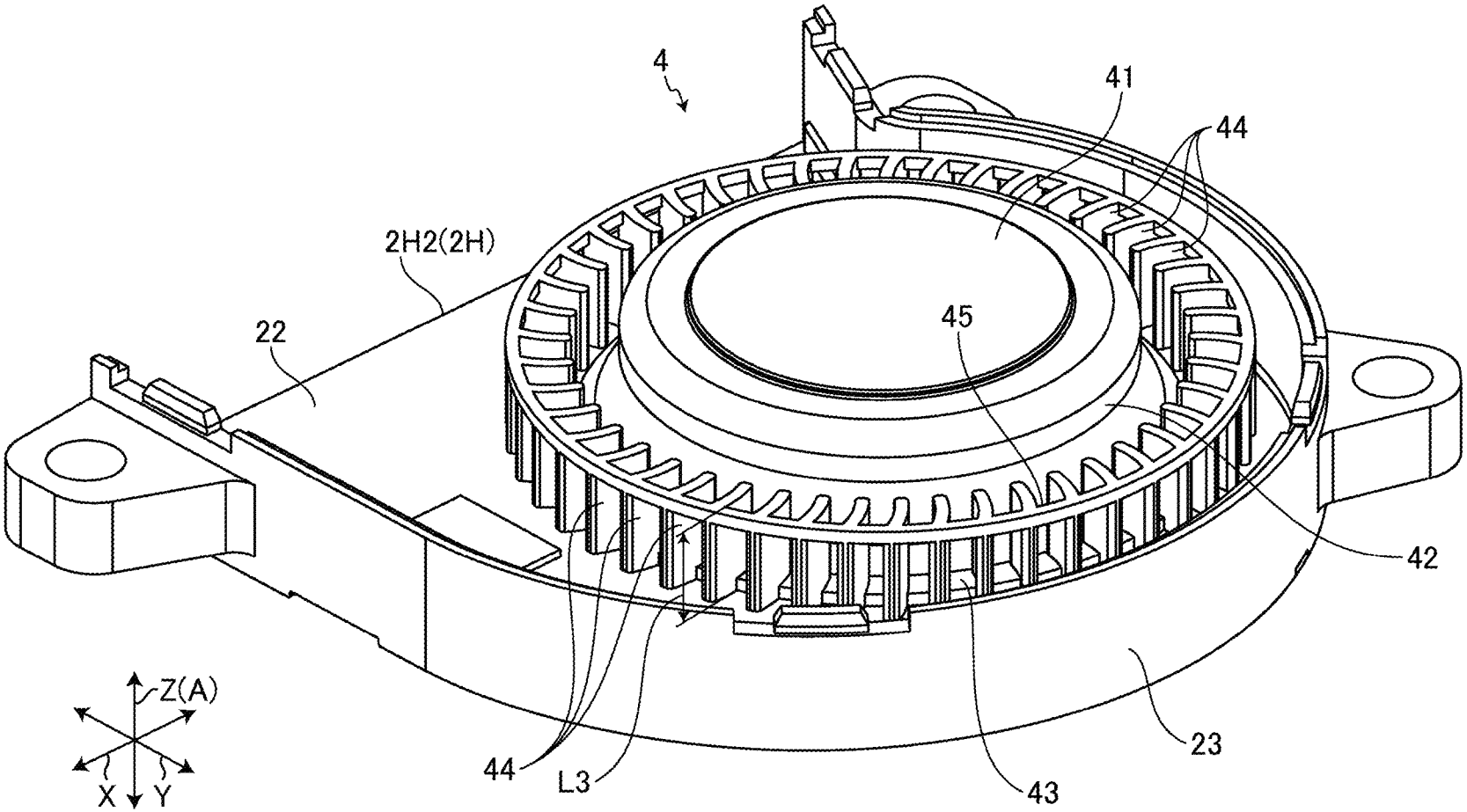
FIG. 4 is a perspective view of an impeller provided in the main body illustrated in FIG. 2.
Figure 5:
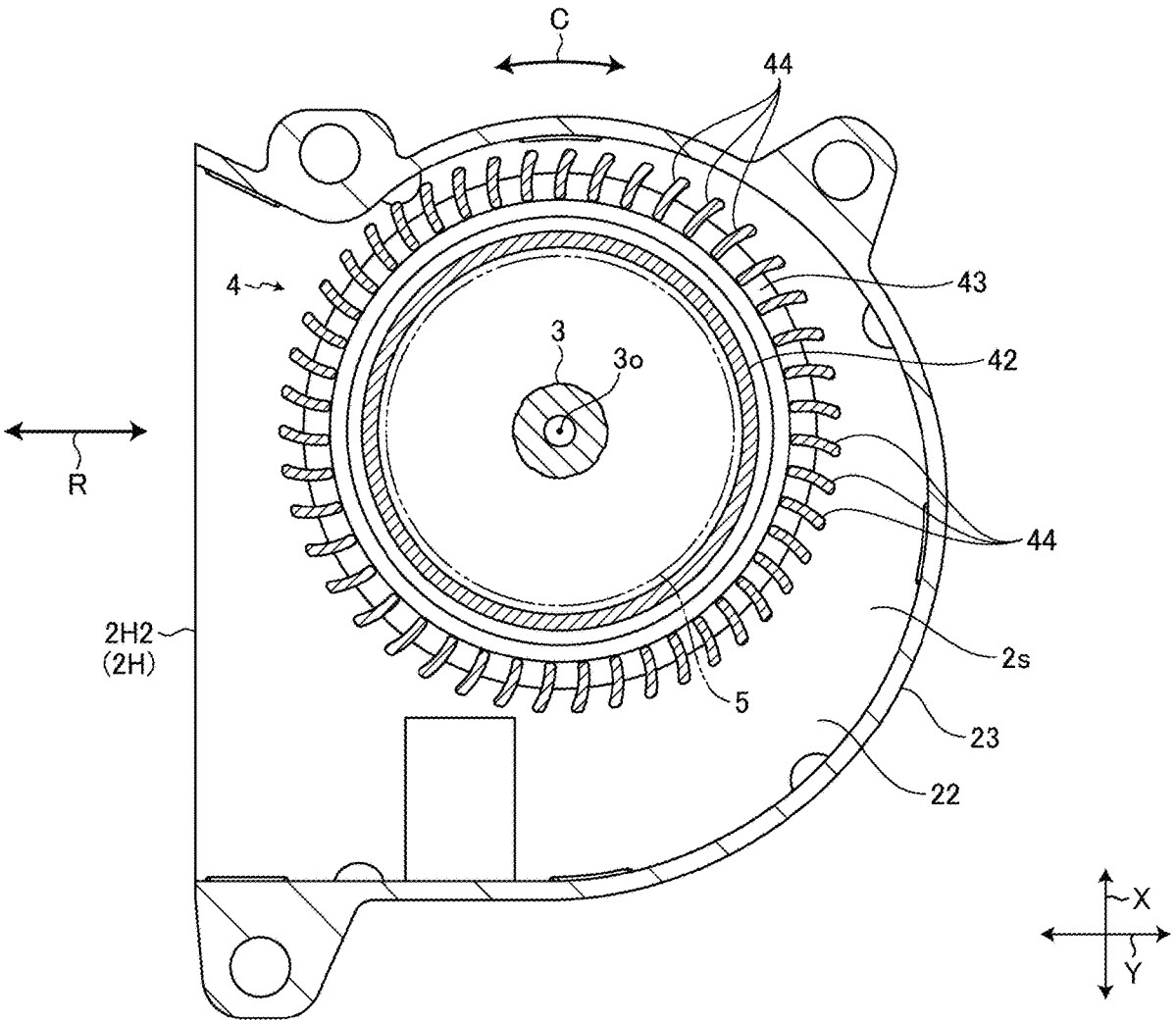
FIG. 5 is a cross-sectional view of the main body illustrated in FIG. 2.
Figure 6:
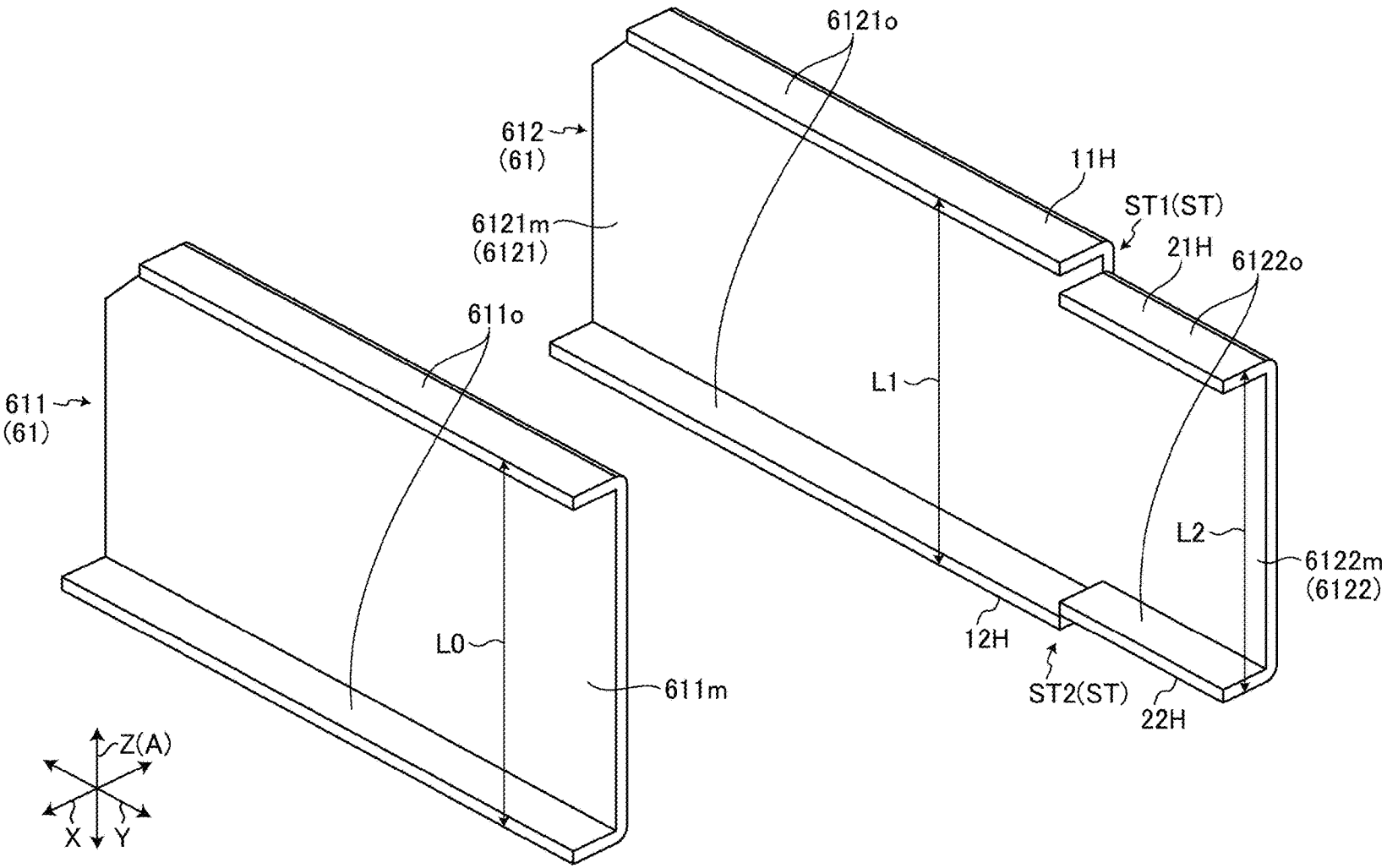
FIG. 6 is a perspective view of a heat sink provided in the main body illustrated in FIG. 2.

FIG. 1 is a perspective view illustrating the rotating device (fan 1) according to an embodiment. FIG. 2 is a partial sectional view of a main body M of the fan 1 illustrated in FIG. 1. FIG. 3 is an exploded perspective view of the main body M illustrated in FIG. 2. FIG. 4 is a perspective view of an impeller 4 provided in the main body M illustrated in FIG. 2. FIG. 5 is a cross-sectional view of the main body M illustrated in FIG. 2. FIG. 6 is a perspective view of a heat sink 6 provided in the main body M illustrated in FIG. 2.

In the description of the fan 1 as the rotating device illustrated in FIG. 1 according to the present embodiment, a direction of a shaft 3 extending to be described below is called an axial direction A, a direction orthogonal to the axial direction A is called a lateral direction X, and a direction orthogonal to the axial direction A and the lateral direction X is called a longitudinal direction Y in order to facilitate understanding of the directions. A direction of the shaft 3 rotating is called a circumferential direction C, and a direction included in the plane orthogonal to the axial direction A and passing through an axis 30 of the shaft 3 and orthogonal to a circumferential direction C is called a radial direction R. In the fan 1 according to the present embodiment, the radial direction R is included in the longitudinal direction Y. Furthermore, in the present embodiment, the axial direction A corresponds to, for example, a vertical direction Z described below.

The fan 1 illustrated in FIG. 1 is built into a computer, for example, and is used for cooling components provided inside the computer, or the like. The fan 1 according to the present embodiment has a function of cooling a heat generating element AT2, such as the central processing unit of the computer. The fan 1 according to the present embodiment also includes the main body M and an additional device AT.

The main body M includes, for example, a casing 2, the shaft 3 (see FIG. 5), the impeller 4, a motor 5 (see FIGS. 4 and 5), the heat sink 6, and a heat pipe 7. The main body M according to the present embodiment is integrally formed with the casing 2 incorporating the impeller 4, and the heat sink 6.

The casing 2 illustrated in FIG. 2 is configured to have an interior space 2*s* formed by, for example, a flat upper casing 21, a flat lower casing 22, and an intermediate casing 23 located between the upper casing 21 and the lower casing 22 in the axial direction A. The upper casing 21 is disposed at a first face 21H facing one side in the axial direction A of a second part 6122, as described below.

The casing 2 has an opening 2H communicating the interior space 2*s* with the outside. The casing 2 according to the present embodiment has, for example, two openings 2H. Among the two openings 2H, a first opening 2H1 is formed at the upper casing 21. Also, among the two openings 2H, a second opening 2H2 is formed by the upper casing 21, the lower casing 22, and the intermediate casing 23.

The first opening 2H1 is a suction port sucking the fluid (air) from the outside into the interior space 2*s* by arranging the impeller 4 at the interior space 2*s* of the casing 2. The second opening 2H2 is a discharge port discharging the fluid (air) from the interior space 2*s* by arranging the impeller 4 at the interior space 2*s* of the casing 2.

The impeller 4 and the motor 5 (see FIG. 5) are arranged at the interior space 2*s*. That is, the casing 2 accommodates the impeller 4 and the motor 5.

The shaft 3 illustrated in FIG. 5 is a so-called rotation axis, for example, a metallic member formed in a cylindrical shape extending along the axial direction A. The shaft 3 has the axis 30 and is rotatably provided around the axis 30. In the fan 1 according to the present embodiment, the shaft 3 is rotatably attached to the lower casing 22.

The impeller 4 is fixed to the shaft 3. The shaft 3 rotates in the circumferential direction C by driving the motor 5 so that a plurality of blades 44 of the impeller 4 are moved along the circumferential direction C, respectively, thereby discharging fluid (air) from the second opening 2H2 as a discharge port.

The impeller 4 illustrated in FIG. 4 includes a top face 41, a side face 42, a bottom face 43, the plurality of blades 44, and a coupling part 45. The top face 41 is fixed to the shaft 3 and is disposed at an uppermost side in the axial direction A in the impeller 4.

The side face 42 is coupled to the top face 41 and has an outer peripheral surface positioned around the axis 30 of the shaft 3. The bottom face 43 is disposed at a lowermost side in the axial direction A in the impeller 4 and couples the plurality of blades 44 at the lower side.

The plurality of blades 44 are evenly spaced at equal intervals around, for example, the axis 30 of the shaft 3. That is, the plurality of blades 44 are spaced with respect to the axis 30 in the circumferential direction C. The coupling part 45 couples the plurality of blades 44 at the upper side. Then, the impeller 4 discharges fluid (air) from the second opening 2H2 as a discharge port to the heat sink 6 by moving the plurality of blades 44 in the circumferential direction C.

The motor 5 illustrated in FIG. 5 is, for example, an electric motor converting electric energy from a power source into a driving force rotating in the circumferential direction C of the shaft 3. The motor 5 is disposed at the interior space 2*s* of the casing 2. The motor 5 is fixed to the casing 2 via a bearing (not illustrated) or the like attached to the shaft 3.

The heat sink 6 illustrated in FIG. 3 is formed by a plurality of heat spreader plates 61 formed of, for example, a metal such as copper having high thermal conductivity. The plurality of heat spreader plates 61 include a plurality of first heat spreader plates 611 disposed at both ends in the lateral direction X and a plurality of second heat spreader plates 612 disposed at the center in the lateral direction X. The heat sink 6 is adjacent to the casing 2 in the radial direction R of the impeller 4.

The plurality of first heat spreader plates 611 are formed having the same shape. The first heat spreader plate 611 is formed by bending both ends in the axial direction A of a punched flat plate. As illustrated in FIG. 6, the first heat spreader plate 611 includes a first heat spreader plate main body 611*m* and a pair of first heat spreader plate opposing portions 6110 located at both ends in the axial direction A in the first heat spreader plate main body 611*m* and opposed to each other in the axial direction A. As illustrated in FIG. 2, the first heat spreader plate 611 is disposed adjacent to the second opening 2H2 as a discharge port in the longitudinal direction Y.

Additionally, a dimension L0 in the axial direction A of the first heat spreader plate 611 is the same as a dimension L1 in the axial direction A of a first part 6121 described below in the second heat spreader plate 612. Furthermore, the dimension in the longitudinal direction Y of the first heat spreader plate 611 is the same as the dimension in the longitudinal direction Y of the first part 6121 of the second heat spreader plate 612. In addition, the plurality of first heat spreader plates 611 are arranged at the same intervals in the lateral direction X.

The second heat spreader plate 612 includes, in the longitudinal direction Y, the first part 6121 adjacent to the second opening 2H2 as a discharge port, and the second part 6122 disposed inside the second opening 2H2 as a discharge port. That is, the heat sink 6 according to the present embodiment includes the first part 6121 adjacent to the second opening 2H2 as a discharge port, and the second part 6122 arranged inside the second opening 2H2 as a discharge port. In other words, in the heat sink 6 of the fan 1 according to the present embodiment, the plurality of heat spreader plates 61 are constituted of the first heat spreader plates 611 and the second heat spreader plates 612. All of the first heat spreader plates 611 are disposed outside the casing 2, the respective first parts 6121 of all of the second heat spreader plates 612 are arranged outside the casing 2, and the respective second parts 6122 of all of the second heat spreader plates 612 are disposed inside the casing 2.

The plurality of second heat spreader plates 612 are formed having the same shape. Each of the second heat spreader plates 612 is formed by bending both ends in the axial direction A of the punched flat plate.

Each of the first parts 6121 illustrated in FIG. 6 includes a first part main body 6121*m* and a pair of first part opposing portions 6121*o* located at both ends in the axial direction A of the first part main body 6121*m* and opposed to each other in the axial direction A.

Each of the second parts 6122 includes a second part main body 6122*m* and a pair of second part opposing portions 6122*o* located at both ends in the axial direction A of the second part main body 6122*m* and opposed to each other in the axial direction A.

A dimension L2 in the axial direction A of the second part 6122 is smaller than the dimension L1 in the axial direction A of the first part 6121. The dimension L2 in the axial direction A of the second part 6122 is larger than a dimension L3 in the axial direction A of the plurality of blades 44 (see FIG. 4). In addition, a first step ST1 (step ST) is formed at a boundary between the first face 21H facing one side in the axial direction A of the second part 6122 illustrated in FIG. 6 and a first face 11H facing the one side in the axial direction A of the first part 6121. A second step ST2 (step ST) is formed at a boundary between a second face 22H facing the other side in the axial direction A of the second part 6122 and a second face 12H facing the other side in the axial direction A of the first part 6121.

Furthermore, the plurality of second heat spreader plates 612 are arranged at the same intervals in the lateral direction X. In the heat sink 6 according to the present embodiment, each interval in the lateral direction X between the plurality of first heat spreader plates 611 and each interval in the lateral direction X between the plurality of second heat spreader plates 612 are the same. In other words, in the heat sink 6 according to the present embodiment, the plurality of heat spreader plates 61 are arranged at the same intervals in the lateral direction X. As illustrated in FIG. 3, the plurality of heat spreader plates 61 are arranged such that the plurality of first heat spreader plates 611 and the respective first parts 6121 of the plurality of second heat spreader plates 612 form a row in the lateral direction X.

The heat pipe 7 is in contact with the first part 6121 illustrated in FIG. 2. In the axial direction A of the impeller 4, the second part 6122 is in contact with the casing 2.

The first face 21H facing the one side in the axial direction A of the second part 6122 abuts the upper casing 21. The second face 22H facing the other side in the axial direction A of the second part 6122 abuts the lower casing 22.

Each of the plurality of heat spreader plates 61 is fixed, for example, to a lower face 7HL of the heat pipe 7, then the second part 6122 of each of the second heat spreader plates 612 is inserted into the second opening 2H2 of the casing 2, and both ends in the vertical direction Z of each of the second heat spreader plates 612 are attached to the upper casing 21 and the lower casing 22.

The heat pipe 7 is formed of, for example, a metal such as copper having high thermal conductivity, and has a function of thermally connecting the heat generating element AT2, such as a central processing unit, to the heat sink 6. The heat pipe 7 is arranged at the first face 11H facing the one side in the axial direction A of the first part 6121. On the other hand, as described above, the upper casing 21 in the casing 2 is arranged at the first face 21H facing the one side in the axial direction A of the second part 6122. Thus, in the upper face view, the heat pipe 7 is arranged adjacent to the upper casing 21 with the first step ST1 as a border. In addition, the heat pipe 7 and the upper casing 21 are not opposed in the radial direction R.

An upper face 7HU in the vertical direction Z of the heat pipe 7 is exposed outside the heat spreader plates 61, while the lower face 7HL in the vertical direction Z of the heat pipe 7 is attached to the plurality of heat spreader plates 61. As illustrated in FIG. 1, the heat pipe 7 according to the present embodiment is formed to extend in the lateral direction X.

The additional device AT includes a substrate AT1, the heat generating element AT2 as a central processing unit, and a heat spreader plate AT3. The substrate AT1 is a base placing the heat generating element AT2 as a central processing unit, and abuts the lower face in the vertical direction Z of the heat generating element AT2. The heat spreader plate AT3 is formed of a metal such as copper having high thermal conductivity, for example, and abuts the upper face in the vertical direction Z of the heat generating element AT2.

As described above, the fan 1 according to the present embodiment includes the shaft 3, the impeller 4 fixed to the shaft 3, the motor 5 rotating the impeller 4, and the casing 2 accommodating the impeller 4 and the motor 5. The casing 2 has the first opening 2H1 as a suction port for a fluid, and the second opening 2H2 as a discharge port. In the radial direction R of the impeller 4, the casing 2 and the heat sink 6 are adjacent. The heat sink 6 has the first part 6121 adjacent to the discharge port and the second part 6122 arranged inside the discharge port. The heat pipe 7 is in contact with the first part 6121. In the axial direction A of the impeller 4, the second part 6122 is in contact with the casing 2. Thus, a part of the heat sink 6 according to the present embodiment enters into and abuts the casing 2. As a result, the fan 1 according to the present embodiment can improve cooling performance.

Furthermore, the plurality of first heat spreader plates 611 according to the present embodiment are formed having the same shape. In addition, the plurality of second heat spreader plates 612 according to the present embodiment are formed having the same shape. Thus, the plurality of heat spreader plates 61 according to the present embodiment can be easily manufactured so that the manufacture of the fan 1 can be facilitated.

Further, the impeller 4 according to the present embodiment includes the plurality of blades 44 rotating around the axis 30. The dimension L2 in the axial direction A of the second part 6122 is larger than the dimension L3 in the axial direction A of the plurality of blades 44. Thus, when a large force is applied from the axial direction A at the fan 1 according to the present embodiment, the second part 6122 receives the large force so that the large force applied to the blades 44 of the impeller 4 can be suppressed.

Furthermore, at the fan 1 according to the present embodiment, the dimension L2 in the axial direction A of the second part 6122 is smaller than the dimension L1 in the axial direction A of the first part 6121. In addition, a first step ST1 (step ST) is formed at a boundary between the first face 21H facing one side in the axial direction A of the second part 6122 and a first face 11H facing the one side in the axial direction A of the first part 6121. A second step ST2 (step ST) is formed at a boundary between a second face 22H facing the other side in the axial direction A of the second part 6122 and a second face 12H facing the other side in the axial direction A of the first part 6121.

At the fan 1 according to the present embodiment, the casing 2 includes the upper casing 21 and the lower casing 22. The first face 21H abuts the upper casing 21, and the second face 22H abuts the lower casing 22. Thus, the generation of noise due to the vibration of the casing 2 can be suppressed. This vibration is caused by the driving of the fan 1 and by the wind generated with the driving of the fan 1.

Furthermore, the heat pipe 7 according to the present embodiment is disposed at the first face 11H facing one side in the axial direction A of the first part 6121. The upper casing 21 of the casing 2 is arranged on the first face 21H facing one side in the axial direction A of the second part 6122. Thus, the upper face 7HU of the heat pipe 7 according to the present embodiment is exposed to the outside, and the heat pipe 7 is adjacent to the casing 2 in the radial direction R. As a result, the cooling performance of the fan 1 according to the present embodiment can be improved by the heat pipe 7 and the casing 2. Moreover, vibration of the casing 2 caused by the driving of the fan 1 and by the wind generated with the driving of the fan 1 can be prevented from being transmitted to the heat pipe 7.

At the fan 1 according to the above-described embodiment, the heat sink 6 is described to include the first heat spreader plates 611 and the second heat spreader plates 612. However, the heat sink 6 according to the present embodiment is not limited to the above. For example, at the heat sink 6 of the fan 1 according to the present embodiment, the plurality of heat spreader plates 61 may all be composed of the second heat spreader plates 612 having the same shape, and the respective second parts 6122 of all the second heat spreader plates 612 may be arranged inside the casing 2.

Although the disclosure has been described based on the embodiment of the rotating device (fan 1) according to the disclosure, the disclosure is not limited to the embodiment, and it is needless to say that various modifications can be made without departing from the gist of the disclosure. Various modifications made without departing from the gist of the disclosure are also included in the technical scope of the disclosure, and it is clear from the description of the claims to those skilled in the art.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A rotating device, comprising:

a shaft;

an impeller fixed to the shaft;

a motor causing the impeller to rotate; and a casing accommodating the impeller and the motor, wherein the casing includes an upper casing, a lower casing, a suction port, and a discharge port for a fluid, the casing and a heat sink are adjacent in a radial direction of the impeller, the heat sink includes a first part adjacent to the discharge port and a second part disposed inside the discharge port, the first part is in contact with a heat pipe, the second part is in contact with the casing in an axial direction of the impeller, a first end in the axial direction of the second part is directly attached to the upper casing, and a second end in the axial direction of the second part is directly attached to the lower casing.

2. The rotating device according to claim 1, wherein the impeller includes a plurality of blades rotating about an axis, and a dimension in the axial direction of the second part is larger than a dimension in the axial direction of the plurality of blades.

3. The rotating device according to claim 1, wherein a dimension in the axial direction of the second part is smaller than a dimension in the axial direction of the first part, a step is formed at a boundary between a first face facing one side in the axial direction of the second part and a first face facing the one side in the axial direction of the first part, and a step is formed at a boundary between a second face facing the other side in the axial direction of the second part and a second face facing the other side in the axial direction of the first part.

4. The rotating device according to claim 3, wherein the first face of the second part abuts the upper casing, and the second face of the second part abuts the lower casing.

5. The rotating device according to claim 4, wherein the heat pipe is disposed at the first face facing the one side in the axial direction of the first part, and the upper casing of the casing is disposed at the first face facing the one side in the axial direction of the second part.

* * * * *